US009752801B2

(12) United States Patent
Verma et al.

(10) Patent No.: US 9,752,801 B2
(45) Date of Patent: Sep. 5, 2017

(54) EJECTOR CYCLE

(75) Inventors: Parmesh Verma, Manchester, CT (US); Thomas D. Radcliff, Vernon, CT (US); Frederick J. Cogswell, Glastonbury, CT (US)

(73) Assignee: Carrier Corporation, Jupiter, FL (US)

( * ) Notice: Subject to any disclaimer, the term of this patent is extended or adjusted under 35 U.S.C. 154(b) by 756 days.

(21) Appl. No.: 13/703,736

(22) PCT Filed: Jul. 20, 2011

(86) PCT No.: PCT/US2011/044623

§ 371 (c)(1),
(2), (4) Date: Jan. 11, 2013

(87) PCT Pub. No.: WO2012/012493

PCT Pub. Date: Jan. 26, 2012

(65) Prior Publication Data

US 2013/0125569 A1 May 23, 2013

Related U.S. Application Data

(60) Provisional application No. 61/367,105, filed on Jul. 23, 2010.

(51) Int. Cl.
*F25B 1/06* (2006.01)
*F25B 1/10* (2006.01)
(Continued)

(52) U.S. Cl.
CPC ..... *F25B 1/06* (2013.01); *F25B 1/10* (2013.01); *F25B 40/00* (2013.01); *F25B 41/00* (2013.01);
(Continued)

(58) Field of Classification Search
CPC ..... F25B 2341/001; F25B 2341/0015; F25B 1/06; F25B 1/10; F25B 40/00; F25B 41/00; F25B 2341/0011
(Continued)

(56) References Cited

U.S. PATENT DOCUMENTS 1,836,318 A 12/1931 Gay
2,931,190 A * 4/1960 Dubitzky ..... 62/114
(Continued)

FOREIGN PATENT DOCUMENTS

CN 1821680 A 8/2006
CN 101004304 A 7/2007
(Continued)

OTHER PUBLICATIONS

Chinese Office Action for CN201180036102.3, dated Aug. 18, 2014.
International Search Report and Written Opinion for PCT/US2011/044623, dated Apr. 11, 2012.

*Primary Examiner* — Ljiljana Ciric
*Assistant Examiner* — Kirstin Oswald
(74) *Attorney, Agent, or Firm* — Bachman & LaPointe, P.C.

(57) ABSTRACT

A system (200; 250; 270) has first (220) and second (222) compressors, a heat rejection heat exchanger (30), first (38) and second (202) ejectors, a heat absorption heat exchanger (64), and a separator (48). The heat rejection heat exchanger is coupled to the second compressor to receive refrigerant compressed by the second compressor. The first ejector has a primary inlet (40) coupled to the heat rejection exchanger to receive refrigerant, a secondary inlet (42), and an outlet (44). The second ejector has a primary inlet (204) coupled to the heat rejection heat exchanger to receive refrigerant, a secondary inlet (206), and an outlet (208). The separator has an inlet (50) coupled to the outlet (44) of the first ejector to
(Continued)

receive refrigerant from the first ejector. The separator has a gas outlet (54) coupled to the secondary inlet (206) of the second ejector via the first compressor (220) to deliver refrigerant to the second ejector. The separator has a liquid outlet (52) coupled to the secondary inlet (42) of the first ejector via the heat absorption heat exchanger to deliver refrigerant to the first ejector.

26 Claims, 6 Drawing Sheets

(51) Int. Cl.
*F25B 40/00* (2006.01)
*F25B 41/00* (2006.01)

(52) U.S. Cl.
CPC ..... *F25B 2341/0011* (2013.01); *F25B 2341/0015* (2013.01)

(58) Field of Classification Search
USPC ..... 62/510, 509, 512, 505, 500, 116, 191
See application file for complete search history.

(56) References Cited

U.S. PATENT DOCUMENTS 3,277,660 A 10/1966 Kemper et al.
3,360,958 A * 1/1968 Miner ..... 62/470
3,686,867 A * 8/1972 Hull ..... 60/667
3,778,969 A * 12/1973 Sudduth ..... B01D 53/00 261/116
4,124,496 A * 11/1978 Cummings ..... 208/361
5,343,711 A * 9/1994 Kornhauser et al. ..... 62/116
6,250,086 B1 * 6/2001 Cho ..... F25B 41/00 62/324.6
6,675,609 B2 * 1/2004 Takeuchi ..... F25B 1/08 62/197
6,857,286 B2 * 2/2005 Ohta ..... B60H 1/323 62/498
7,178,359 B2 * 2/2007 Oshitani ..... F25B 5/00 62/500
7,254,961 B2 8/2007 Oshitani et al.
7,367,202 B2 * 5/2008 Yamada et al. ..... 62/500
7,757,514 B2 * 7/2010 Oshitani et al. ..... 62/500
8,418,482 B2 * 4/2013 Bush ..... F25B 1/10 62/117
2002/0124592 A1 * 9/2002 Takeuchi et al. ..... 62/500
2004/0003608 A1 * 1/2004 Takeuchi et al. ..... 62/170
2004/0123624 A1 * 7/2004 Ohta ..... B60H 1/323 62/498
2005/0268644 A1 * 12/2005 Oshitani ..... B60H 1/323 62/500
2006/0218964 A1 * 10/2006 Saito ..... B60H 1/3211 62/500
2006/0266072 A1 * 11/2006 Takeuchi ..... F25B 40/00 62/500
2007/0000262 A1 * 1/2007 Ikegami ..... F25B 41/00 62/170
2007/0028630 A1 2/2007 Yamada et al.
2007/0028646 A1 * 2/2007 Oshitani et al. ..... 62/500
2007/0163293 A1 * 7/2007 Ikegami ..... F25B 41/00 62/500
2007/0271942 A1 * 11/2007 Yokoyama ..... F25B 41/00 62/278
2008/0041079 A1 * 2/2008 Nishijima ..... F25B 5/00 62/191
2008/0196446 A1 8/2008 Nakamura et al.
2009/0095003 A1 * 4/2009 Nagano et al. ..... 62/217
2009/0229304 A1 * 9/2009 Ogata ..... F25B 5/04 62/500
2010/0031582 A1 * 2/2010 Matsuda ..... B30B 9/327 51/309
2010/0147006 A1 * 6/2010 Taras ..... F25B 7/00 62/335
2010/0162751 A1 * 7/2010 Nishijima ..... F25B 1/10 62/500
2010/0199715 A1 * 8/2010 Lifson ..... F25B 40/00 62/510
2010/0223938 A1 * 9/2010 Bush et al. ..... 62/117
2010/0313582 A1 * 12/2010 Oh ..... F25B 9/008 62/115
2011/0005268 A1 * 1/2011 Oshitani ..... F25B 41/00 62/500
2011/0247351 A1 * 10/2011 Alston ..... B60H 1/00435 62/235.1

FOREIGN PATENT DOCUMENTS

JP 2001221517 A * 8/2001
JP 2010-133605 A 6/2010

* cited by examiner

EJECTOR CYCLE

CROSS-REFERENCE TO RELATED APPLICATION

Benefit is claimed of U.S. Patent Application Ser. No. 61/367,105, filed Jul. 23, 2010, and entitled "Ejector Cycle", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446. Another method proposed for controlling the ejector is by using hot-gas bypass. In this method a small amount of vapor is bypassed around the gas cooler and injected just upstream of the motive nozzle, or inside the convergent part of the motive nozzle. The bubbles thus introduced into the motive flow decrease the effective throat area and reduce the primary flow. To reduce the flow further more bypass flow is introduced.

SUMMARY

One aspect of the disclosure involves a system having a first compressor, a second compressor, a heat rejection heat exchanger, a first ejector, a second ejector, a heat absorption heat exchanger, and a separator. The heat rejection heat exchanger is coupled to the second compressor to receive refrigerant compressed by the second compressor. The first ejector has a primary inlet coupled to the heat rejection exchanger to receive refrigerant, a secondary inlet, and an outlet. The second ejector has a primary inlet coupled to the heat rejection heat exchanger to receive refrigerant, a secondary inlet, and an outlet. The second ejector outlet is coupled to the second compressor to deliver refrigerant to the second compressor. The separator has an inlet coupled to the outlet of the first ejector to receive refrigerant from the first ejector. The separator has a gas outlet coupled to the secondary inlet of the second ejector via the first compressor to deliver refrigerant to the second ejector. The separator has a liquid outlet coupled to the secondary inlet of the first ejector via the heat absorption heat exchanger to deliver refrigerant to the first ejector.

In various implementations, the separator may be a gravity separator. The system may have no other separator (i.e., the separator is the only separator). The system may have no other ejector. The refrigerant may comprise at least 50% carbon dioxide, by weight. The system may further include an additional heat exchanger positioned between the compressors. The additional heat exchanger may be an intercooler discharging heat to an environmental heat transfer fluid. The additional heat exchanger may be an economizer heat exchanger having a heat rejection leg and a heat absorption leg. The heat rejection leg may be positioned between: the heat rejection heat exchanger; and the inlet of the first ejector. The heat absorption leg may be positioned between the second ejector and the second compressor.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
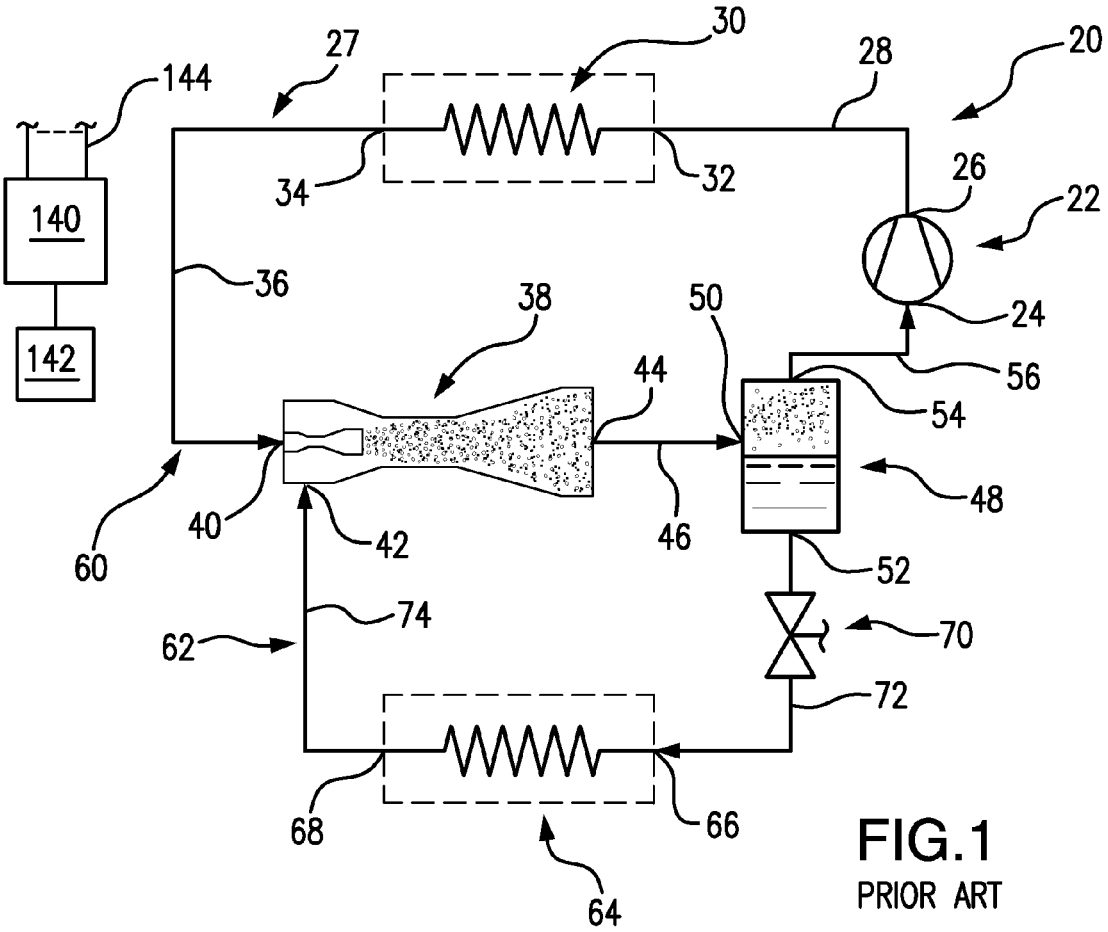
FIG.1 PRIOR ART
FIG. 1 is a schematic view of a prior art ejector refrigeration system.
Figure 2:
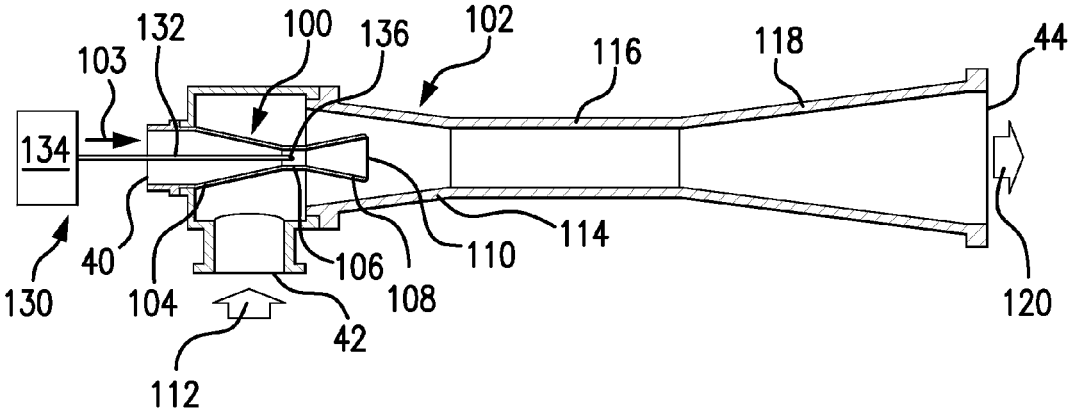
FIG. 2 PRIOR ART
FIG. 2 is an axial sectional view of an ejector.
Figure 3:
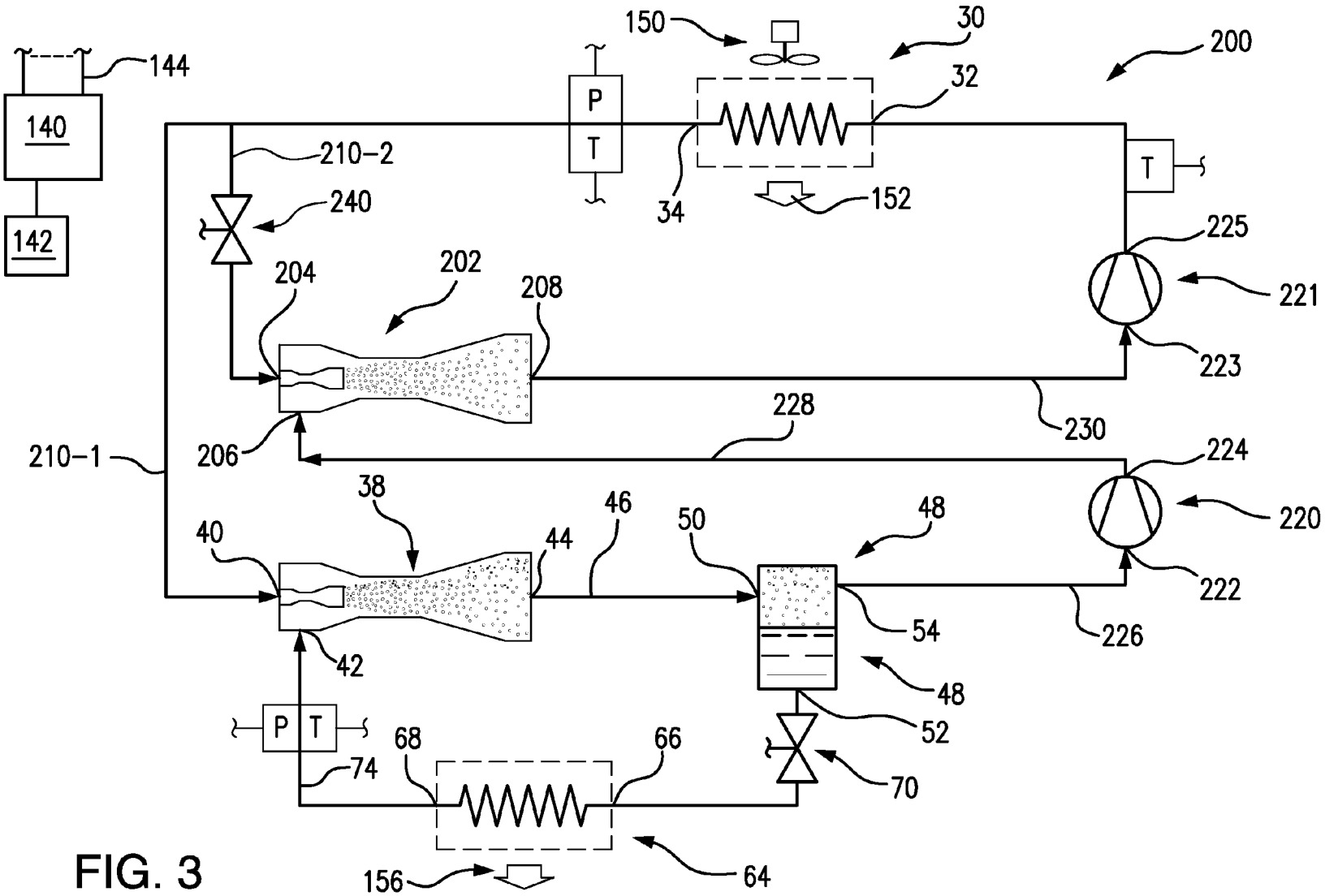
FIG. 3 is a schematic view of a first refrigeration system.

FIG. 3 shows an ejector cycle vapor compression (refrigeration) system 200. The system 200 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors.

The ejector 38 is a first ejector and the system further includes a second ejector 202 having a primary inlet 204, a secondary inlet 206, and an outlet 208 and which may be configured similarly to the first ejector 38. The line 210 exiting the heat rejection heat exchanger outlet and replacing the line 36 splits into branches 210-1 and 210-2 respectively feeding the primary inlets 40 and 204.

The compressor 22 is replaced by a first compressor 220 and a second compressor 221 having respective inlets 222, 223 and outlets 224, 225. Rather than returning directly to the compressor, the refrigerant flow exiting the separator outlet 54 passes through a suction line 226 to the inlet 222 of the first compressor. A discharge line 228 of the first compressor extends to the second ejector secondary inlet 206. Within the second ejector, this second secondary flow combines with the second primary flow through the inlet 204 in a similar fashion as the combining of the secondary and primary flows in the first ejector. The second combined flow exits the outlet 208 to a suction line 230 of the second compressor extending to the inlet 223 of the second compressor. Flow exiting the second compressor passes via the second compressor discharge line 232 to the gas cooler inlet 32.

A controllable valve 240 (e.g., a solenoid valve) is positioned to selectively block flow through/along the second branch 210-2. The opening and closing of the valve 240 to unblock and block this flow may be used to switch the system 200 between a first mode of operation and a second mode of operation.

In the second mode of operation, the flow along the second branch 210-2 is blocked and the entire output of the compressors and gas cooler passes along the first branch 210-1 and enters the primary inlet 40 of the first ejector 38. Refrigerant discharged from the first compressor 220 may continue to pass through the second ejector 202 (between the secondary inlet 206 and the outlet 208) but there is no primary inlet flow with which it mixes. Thus, in the first mode, more refrigerant passes through the second compressor 221 than passes through the first compressor 220; whereas, in the second mode, the same refrigerant flow passes through both compressors.

As is discussed further below, in an exemplary embodiment, the ejectors 38 and 202 are controllable ejectors such as described above. If the needle valve of the second ejector 202 is capable of shutting flow through the second branch 210-2, the valve 240 may be eliminated. In alternative embodiments, the ejectors 38 and/or 202 may be fixed geometry (non-controllable) ejectors.

In an exemplary embodiment, the compressors 220 and 221 represent sections of a single larger compressor. For example, the first compressor 220 may represent two cylinders of a three-cylinder reciprocating compressor coupled in parallel or in series to each other. The second compressor 221 may represent the third cylinder. In that embodiment, the speed of the two compressors will always be the same. In alternative embodiments, the compressors may have separate motors and may be separately controlled (e.g., to different relative speeds depending upon operating condition).

In the exemplary system, compressor speed is also controllable as is the valve 70. Along with the two ejectors, this provides an exemplary four continuously variable controlled parameters for the controller 140 plus the bistatic control over the valve 240. The controller 140 receives sensor input from one or more temperature sensors T and pressure sensors P. FIG. 3 shows a temperature sensor and a pressure sensor positioned to measure temperature and pressure at the gas cooler outlet. These may be used with controllable ejectors to set the high side pressure to an optimum value. Another pressure sensor and temperature sensor are positioned to respectively measure pressure and temperature at the evaporator outlet (and first ejector secondary inlet). These may be used to control the valve 70 if it is an EXV. The pressure sensor may also be used to determine mode switching. Alternatively to the temperature sensor, a bulb may be used if the valve 70 is a thermal expansion valve (TXV). An additional temperature sensor is positioned to measure a temperature associated with the space or medium being cooled by the evaporator. For example, it may measure the temperature of a refrigerated box or compartment (e.g., via being positioned at an air inlet to the evaporator to measure the inlet temperature of the airflow across the evaporator). This temperature sensor may be used for capacity control (e.g., controlling the compressor speed if variable or cycling the system on/off). Yet another temperature sensor may measure the discharge temperature of the second compressor (or inlet temperature to the gas cooler). This may be used to control the inlet condition to the second compressor by varying the primary flow through the second ejector. FIG. 3 also shows a fan 150 (e.g., an electric fan) driving an airflow 152 across the gas cooler 30. As is discussed below, one or more airflows 156 may be similarly driven across the evaporator 64. This fan may also be controllable.

Figure 4:
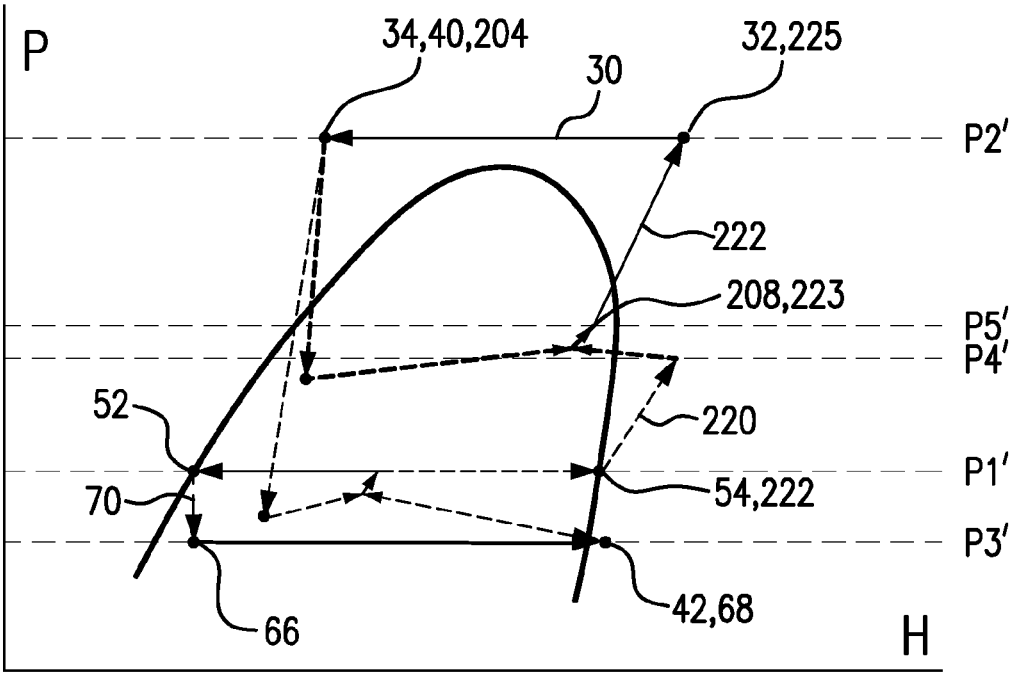
FIG. 4 is a pressure-enthalpy diagram of the system of FIG. 3 in a first mode of operation.
Figure 5:
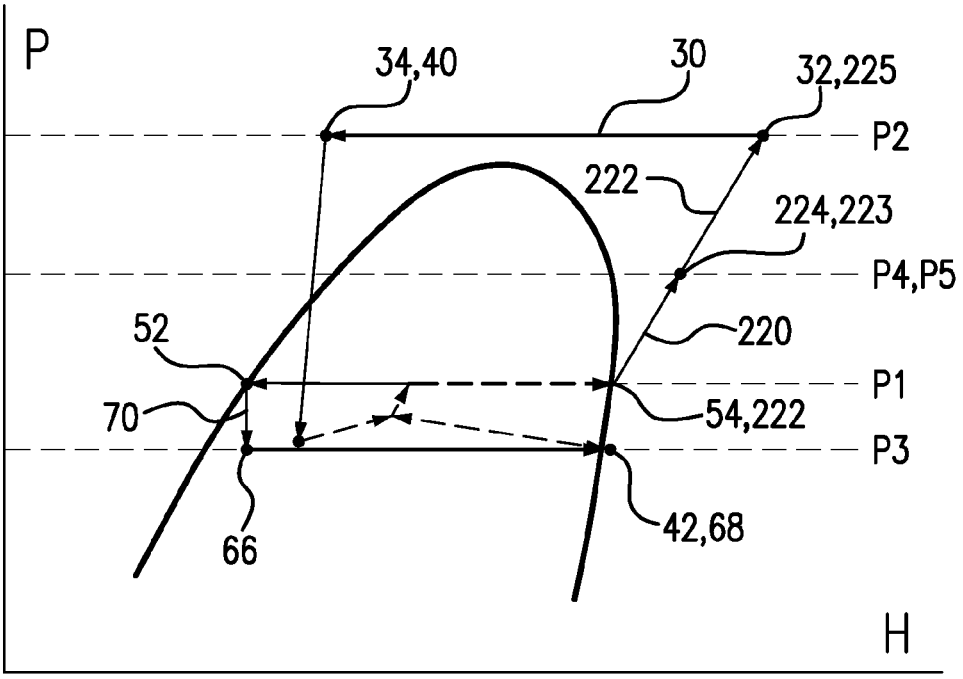
FIG. 5 is a pressure-enthalpy diagram of the system of FIG. 3 in a second mode of operation.

FIGS. 4 and 5 respectively show operation of the system 200 in the first and second modes. The second mode operation of FIG. 5 generally resembles operation of the baseline system 20 with the path from the inlet 222 of the first compressor 220 to the outlet 225 of the second compressor 221 replacing the path from the inlet 24 to the outlet 26 of the compressor 22. Depending upon the nature of the compressor(s) there may be differences in the nature of the compression in those two stages. Additionally, there may be a slight jump in the Mollier diagram associated with the flow passing between the secondary inlet 206 and the outlet 208 of the second ejector 202 (there being no primary flow through the ejector for this flow to mix with).

FIG. 5 shows exemplary second mode pressures and enthalpies at various locations in the system. The first compressor's suction pressure is shown as P1. The second compressor compresses the gas to a discharge pressure P2 at increased enthalpy. The gas cooler 30 decreases enthalpy at essentially constant pressure P2 (the "high side" pressure). The evaporator 64 operates at a pressure P3 ("low side" pressure) below the suction pressure P1. The separator 48 operates at P1. The pressure lift ratio is provided by the first ejector 38. The first ejector 38 raises the pressure from P3 to P1. In the exemplary implementation, the separator 48 outputs pure (or essentially pure (single-phase)) gas and liquid from the respective outlets 54 and 52. In alternative implementations, the gas outlet may discharge a flow containing a minor (e.g., less than 50% by mass, or much less) amount of liquid and/or the liquid outlet may similarly discharge a minor amount of gas.

In this simplified depiction, the first compressor discharges at a pressure P4. The second compressor has a suction pressure P5 which is essentially equal thereto. As noted above, the second ejector 202 may provide a small jog or disturbance in the P-H plot between the two compressors.

In the first mode of operation, a higher total lift is required than in the second mode. In the FIG. 4 first mode of operation, the high side pressure is shown as P2', the low side pressure is shown as P3', and the first compressor's suction pressure is shown as P1'. The first compressor discharges at a pressure P4'. The second compressor has a suction pressure P5'. The second ejector 202 provides a lift of P5' minus P4'.

In one group of examples, the system is the refrigeration system of a refrigerated cargo container or a refrigerated trailer. Switching between first and second modes may responsive to one or both of user-entered compartment temperature (setpoint) and sensed ambient temperature. For example the second mode may be for low differences and temperatures between the evaporator 64 and the gas cooler 30 (e.g., low temporary or steady state differences in temperatures between a refrigerated space/compartment and exterior/ambient conditions). For example, this may be used during initial startup when the compartment is still warm, or when the compartment is set for refrigeration (e.g., 2C or higher) and the ambient temperature is cool; whereas the first mode may be for higher temperature differences such as when the compartment is set to freezing, or when the ambient temperature is high.

Figure 6:
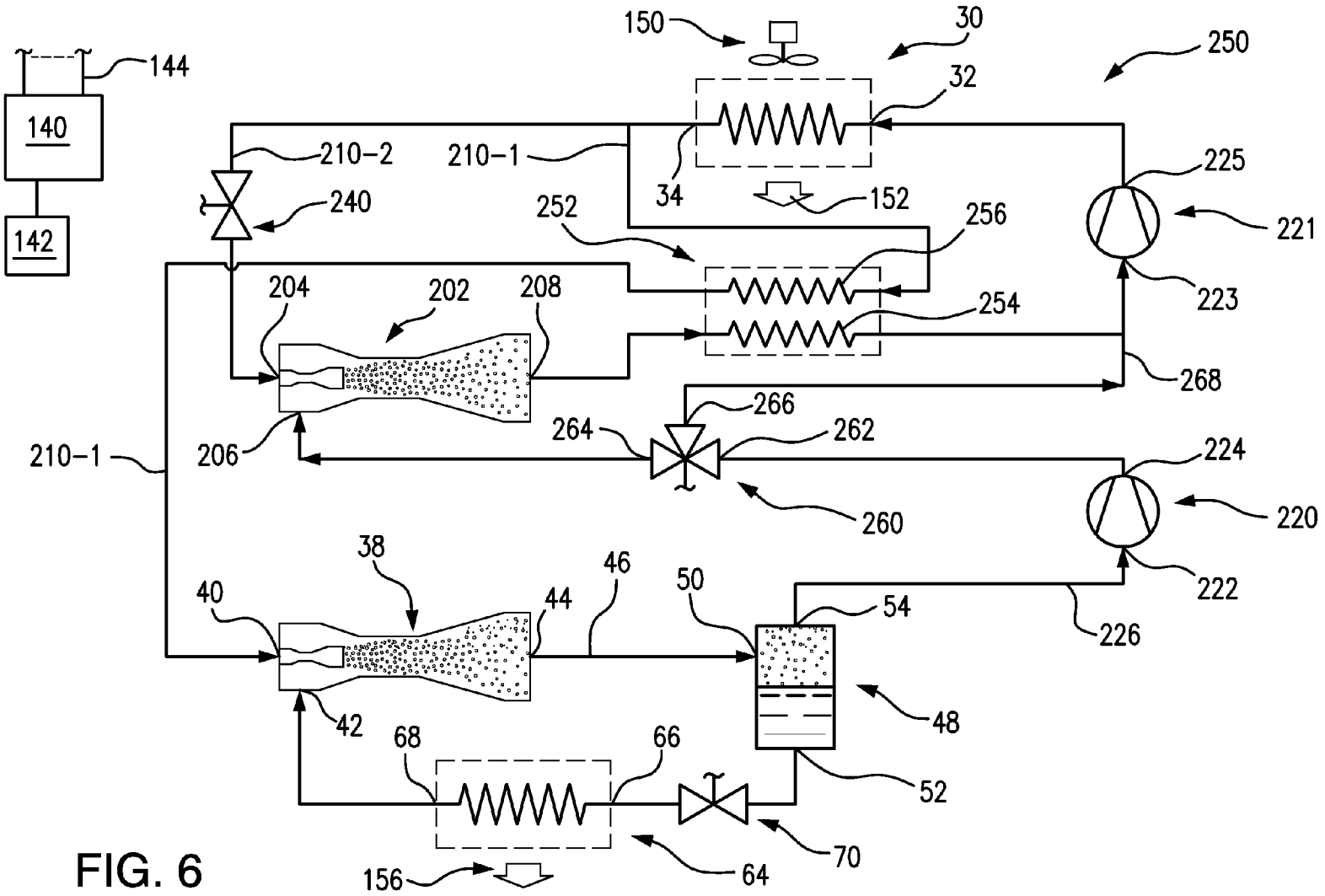
FIG. 6 is a schematic view of a second refrigeration system.

FIG. 6 shows yet a further variation which may otherwise be similar to the system of FIG. 3 (e.g., with similar sensors, etc.). The system 250 includes an economizer heat exchanger 252 having a leg 254 (heat absorption leg) along the suction line between the second ejector and the second compressor. The leg 254 is in heat exchange relationship with a leg 256 (heat rejection leg) in the branch 210-1 of the heat rejection heat exchanger outlet line between the heat rejection heat exchanger outlet and the first ejector primary inlet. A valve 260 has first and second ports 262 and 264 along the line 228, respectively upstream and downstream. The valve 260 has a third port 266 to a line 268 which merges with the line 230 at suction conditions of the second compressor 221. The exemplary valve 260 is bistatic. A first condition of the valve 260 provides communication between the ports 262 and 264 while blocking the port 266. This may be used for operation of the system in its first mode. The second condition of the valve 260 provides communication between the port 262 and port 266 but blocks the port 264. This provides a bypass flow to remove the ejector first leg 254 from the system, effectively passing refrigerant directly from the first compressor to the second compressor. This second condition of valve 260 prevents a reverse heat transfer in the economizer heat exchanger (i.e., prevents heating of refrigerant in the leg 256 from refrigerant in the leg 254) when there is little flow through the second ejector. With the valve 260 in its first condition and the system in its first mode, the economizer cools the first ejector primary inlet flow below what it otherwise would be. The valve 260 adds another bistatic variable for control by the controller.

The remaining operation may be similar to that of the previously-described embodiments. Control algorithms may combine traditional or further-modified economizer control algorithms.

Figure 7:
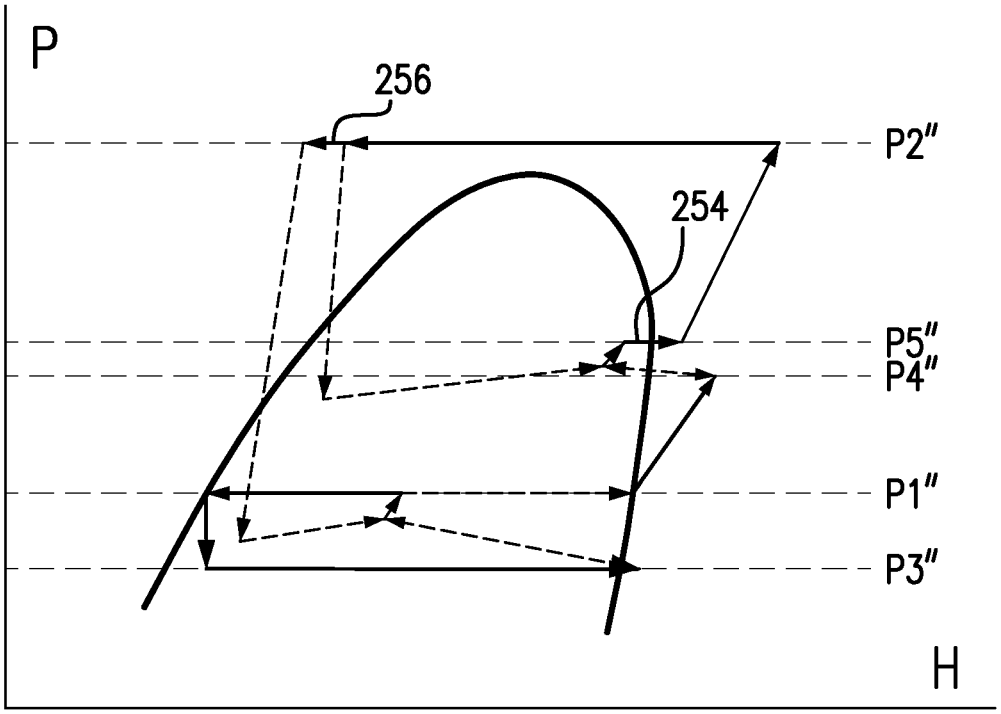
FIG. 7 is a pressure-enthalpy diagram of the system of FIG. 6 in a first mode of operation.

FIG. 7 is a Mollier diagram of the system 250 in its first mode (dual ejector economized mode). A second mode (single ejector economized mode) would have a similar relationship to FIG. 7 as FIG. 5 does to FIG. 4.

Figure 8:
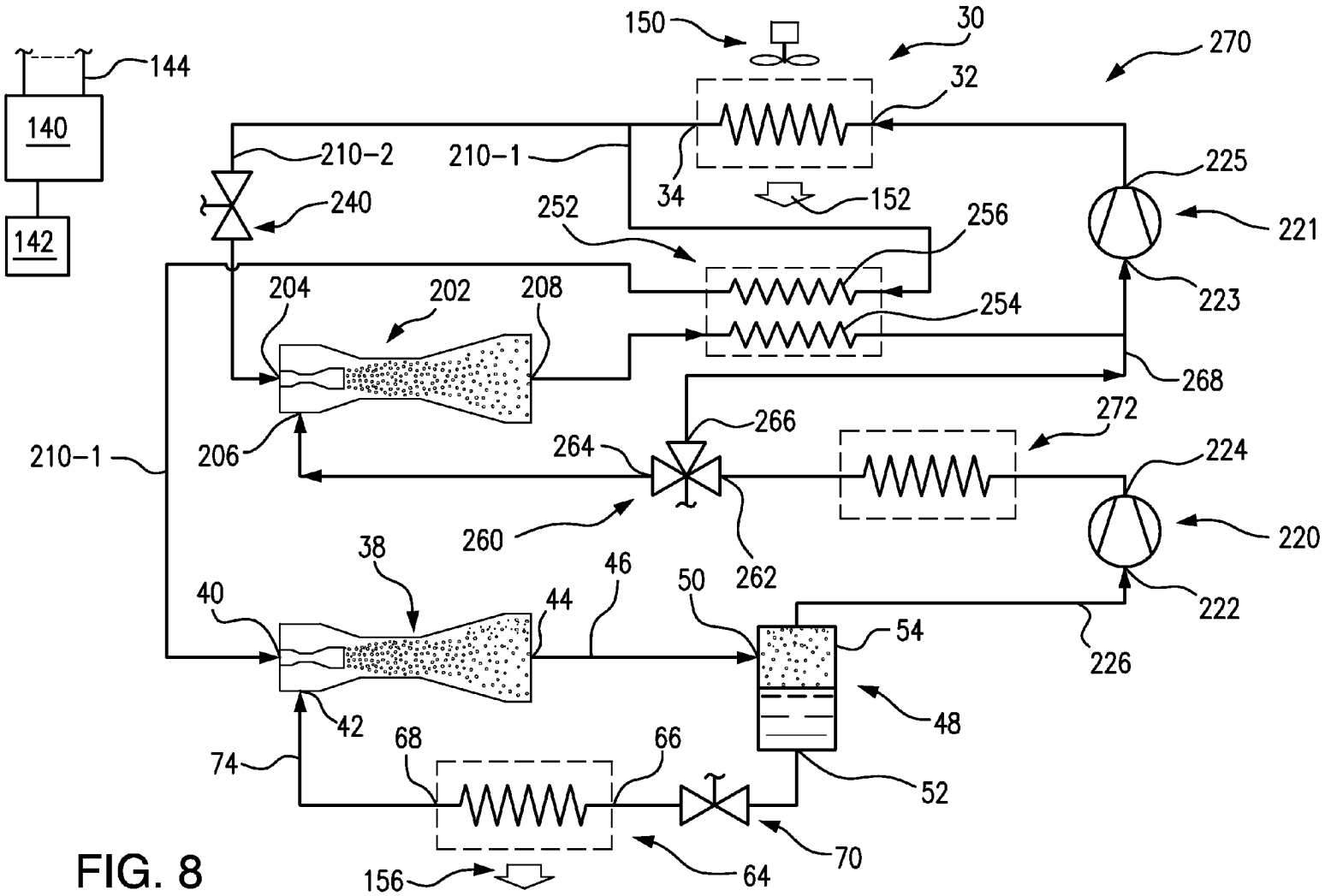
FIG. 8 is a schematic view of a third refrigeration system.

FIG. 8 shows a system 270 which may otherwise be similar to the systems 200 and 250 but which, in addition to the economizer heat exchanger, includes an intercooler 272 in the discharge line of the first compressor upstream of the second ejector secondary inlet. The intercooler may be cooled by ambient heat transfer fluid (e.g., air for many applications). The Mollier diagrams would be similar to those for the system 250, but having a leftward horizontal (near constant pressure but decreasing enthalpy) segment between the outlet 224 of the first compressor and the secondary inlet 206 of the second ejector.

In an exemplary control method, the controller 140 may vary compressor speed to control overall system capacity. Increasing compressor speed will increase the flow rate to both ejectors (absent additional differential control of the ejectors). Increased flow to the first ejector 38 will increase system cooling capacity. Increased flow to the second ejector 202 will increase its pressure lift (raise P5' relative to P4' (and similarly affect the other embodiments)). This will cool the refrigerant entering the second compressor 222 and, if an economizer heat exchanger 250 is present, decrease the temperature of the liquid entering the first ejector 38. This effect further increases system capacity and efficiency.

The valve 70 (e.g., variable expansion valve) may be controlled to, in turn, control the state of the refrigerant exiting the outlet 68 of the evaporator 64. Control may be performed so as to maintain a target superheat at such outlet 68. The actual superheat may be determined responsive to controller inputs received from the relevant sensors (e.g., responsive to outputs of a temperature sensor and a pressure sensor between the outlet 68 and the first ejector secondary inlet 42). To increase the superheat, the valve 70 is closed; to decrease the superheat, the valve 70 is opened (e.g., in stepwise or continuous fashion). In an alternate embodiment, the pressure can be estimated from a temperature sensor (not shown) along the saturated region of the evaporator. Controlling to provide a proper level of superheat ensures good system performance and efficiency. Too high a superheat value results in a high temperature difference between the refrigerant and air and, thus, results in a lower evaporator pressure P3'. If the valve 70 is too open, the superheat may go to zero and the refrigerant leaving the evaporator will be saturated. Too low a superheat indicates that liquid refrigerant is exiting the evaporator. Such liquid refrigerant does not provide cooling and must be re-pumped by the first ejector.

The controllable ejectors may be used to control the high-side pressure P2 (P2', etc.). High-side pressure P2 may be controlled in order to optimize system efficiency. For example, with a transcritical cycle, such as using carbon dioxide as the refrigerant, raising the high-side pressure decreases the enthalpy at the gas cooler outlet 34 and increases the cooling available for a given compressor mass flow rate. However, increasing the high-side pressure also increases the compressor power consumption. For a given system, there may be an optimum high-side pressure value to maximize system efficiency at a given operating condition. This target pressure may depend on factors such as ambient temperature, compressor speed, and evaporation temperatures. To raise high-side pressure to the target value, the two ejectors are simultaneously closed (e.g., in a continuous or stepwise fashion until the desired pressure is reached). Similarly, to lower high-side pressure, the two ejectors are opened.

Differential control of the two ejectors may provide other changes. For example, the second ejector may be used to control the state of the refrigerant entering the second compressor 221. More flow reduces the compressor discharge temperature, and reduces the required power per amount of refrigerant flow. There may be an optimum entrance state, typically near the vapor saturation line, that produces the best cycle efficiency. There may be operating conditions where it is not desirable to have any flow through the second ejector. Valve 240 may be used to stop this flow if ejector 202 is not controllable, or if it cannot completely stop the primary flow through port 204.

There may be operating conditions where the economizer heat exchanger 250 provides no benefit or even negative benefit. This can happen when the temperature of the refrigerant at the second ejector outlet 208 is warmer than the refrigerant at the outlet 34 of the gas cooler. The three way valve 260 is then used to switch the flow from the first compressor outlet 224 to bypass the second ejector 260 and go straight to the suction port 223 of the second compressor. In addition valve 260 may also provide a benefit by eliminating any undesirable pressure drop that may occur if flow is sent through the suction port 206 of ejector 202 with no motive flow (the "jog" described above).

The second ejector and economizer may provide significant efficiency benefit for systems that operate over a larger pressure ratio. They may be less beneficial (and may even be undesirable) for a system operating with little pressure ratio or at high evaporator temperature. The system described may be particularly suited for transport refrigeration (e.g., a refrigerated truck or trailer or cargo/shipping container wherein the evaporator is in the interior or in airflow communication therewith and the gas cooler is exterior or in airflow communication with the exterior) where there is a large range in required operating conditions. For example, when the system is turned on the sensed box temperature may be very warm (e.g., >80 F (27 C)). Under these conditions, it is desirable to use neither the second ejector nor economizer. The controller runs the system in its second mode where valve 240 is closed and valve 260 bypasses flow around ejector 202 and economizer heat exchanger 252. The control system monitors the evaporator exit pressure P3. As the box temperature drops and P3 drops below a set (or calculated) threshold value, the controller switches the system to the first mode, where valve 240 opens and valve 260 passes the flow through the suction port of ejector 202. If $CO_2$ is the refrigerant, an exemplary set pressure may be 609 psia (4.2 MPa) which corresponds to a saturation temperature of 45 F (7 C). The controller maintains the system in the first mode for evaporation temperatures less than 45 F (7 C) and may return the system to the second mode for greater evaporator temperatures.

Other particular uses of the transport container may involve the controller switching modes at different thresholds. For example, particular thresholds will depend upon the target box/container/compartment temperature (which may depend upon the particular goods being transported). The actual compartment temperature and ambient temperature may then influence when the controller switches between modes and how the controller controls the remaining controllable parameters.

In the steady state operation, the control system may iteratively optimize the settings of these parameters to achieve a desired goal (e.g., minimize power consumption) which may be directly or indirectly measured. Alternatively, the relative control may be subject to pre-programmed rules to achieve the desired results in the absence of real time optimization. The same optimization may be used during changing conditions (e.g., changing external temperature of a refrigeration system). Yet other methods may be used in other transition situations (e.g., cool-down situations, defrost situations, and the like).

Other control protocols may be associated with: fixed speed compressors; and/or one or both ejectors being non-controllable; and/or use of a TXV or fixed orifice in place of an EXV as the expansion device 70.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system (200; 250; 270) comprising: a first compressor (220) and a second compressor (221); a heat rejection heat exchanger (30) coupled to the second compressor to receive refrigerant compressed by the second compressor; a first ejector (38) having: a primary inlet (40) coupled to the heat rejection heat exchanger to receive refrigerant; a secondary inlet (42); and an outlet (44); a heat absorption heat exchanger (64); a second ejector (202) having: a primary inlet (204) coupled to the heat rejection heat exchanger to receive refrigerant; a secondary inlet (206); and an outlet (208) coupled to the second compressor to deliver refrigerant to the second compressor; compressor, the second compressor positioned downstream of the outlet of the second ejector to compress refrigerant passing from the outlet of the second ejector to the heat rejection heat exchanger; and a separator (48) having: an inlet (50) coupled to the outlet of the first ejector to receive refrigerant from the first ejector; a gas outlet (54) coupled to the secondary inlet of the second ejector via the first compressor to deliver refrigerant to the second ejector; and a liquid outlet (52) coupled to the secondary inlet of the first ejector via the first heat absorption heat exchanger to deliver refrigerant to the first ejector.

2. The system of claim 1 further comprising:

a controllable expansion device (70) between the separator liquid outlet and the heat absorption heat exchanger.

3. The system of claim 1 wherein:

the separator is a gravity separator;

a single phase gas flow exits the gas outlet; and a single phase liquid flow exits the liquid outlet.

4. The system of claim 1 wherein:

the system has no other separator.

5. The system of claim 1 wherein: the system has no other ejectors other than the first ejector and the second ejector.

6. The system of claim 1 further comprising:

a controllable valve (240) having: an open condition permitting flow from the heat rejection heat exchanger to the second ejector primary inlet; and a closed condition preventing said flow.

7. The system of claim 1 further comprising an economizer heat exchanger (252) having:

a heat rejection leg (256) positioned between:

a) the heat rejection heat exchanger; and b) the inlet of the first ejector; and a heat absorption leg (254) positioned between:

c) the outlet of the second ejector; and b) the second compressor.

8. The system of claim 1 wherein:

refrigerant comprises at least 50% carbon dioxide, by weight.

9. The system of claim 1 wherein:

the first and second compressors are separately powered.

10. The system of claim 1 wherein:

the first and second compressors are separate stages of a single compressor.

11. The system of claim 1 wherein:

a line 210 from an outlet (34) of the heat rejection heat exchanger splits into a first branch (210-1) and a second branch (210-2) respectively feeding the first ejector primary inlet (40) and the second ejector primary inlet (204) without passing through the first compressor or the second compressor.

12. The system of claim 1 wherein:

a refrigerant flowpath passes from the first compressor through the second ejector and to the second compressor before reaching the heat rejection heat exchanger.

13. A method for operating the system of claim 1 comprising running the system in a first mode wherein:

refrigerant received from the second compressor by the heat rejection heat exchanger rejects heat in the heat rejection heat exchanger to produce initially cooled refrigerant;

the initially cooled refrigerant splits into a first primary flow received by the first ejector primary inlet and a second primary flow received by the second ejector primary inlet;

in the respective first ejector and second ejector, the first primary flow and second primary flow respectively join with a first secondary inlet flow and second secondary inlet flow to respectively form a first outlet flow and a second outlet flow;

the first outlet flow is separated in the separator into a first flow and a second flow, the first flow becoming the first secondary inlet flow and the second flow becoming the second secondary inlet flow;

the first flow passes through the first heat absorption heat exchanger;

the second flow passes through the first compressor and is compressed before reaching the second ejector secondary inlet; and the second secondary inlet flow and second primary flow merge in the second ejector to form the second outlet flow and pass to the second compressor where the second outlet flow is compressed.

14. The method of claim 13 wherein:

the first flow has a higher proportion of liquid relative to gas than does the second flow.

15. The method of claim 13 further comprising operating in a second mode wherein:

the second primary flow is prevented.

16. The method of claim 15 wherein, in the second mode, flow passes from the first compressor through the second ejector secondary inlet and through the second ejector to the second compressor to be compressed and delivered to the heat rejection heat exchanger.

17. The method of claim 13 wherein:

operation in the first mode is controlled by a controller (140) programmed to control operation of the first ejector, the second ejector, the first compressor, the second compressor, and a controllable expansion device (70) between the separator liquid outlet and the heat absorption heat exchanger;

the first primary flow and second primary flow consist essentially of supercritical or liquid states; and the first secondary inlet flow and second secondary inlet flow consist essentially of gas.

18. The method of claim 13 wherein, in the first mode, the entire second outlet flow passes to the second compressor.

19. A system (200; 250; 270) comprising: a first compressor (220) and a second compressor (221); a heat rejection heat exchanger (30) positioned downstream of the second compressor and coupled to the second compressor to receive refrigerant compressed by the second compressor; a first ejector (38) having: a primary inlet (40) coupled to the heat rejection heat exchanger to receive refrigerant; a secondary inlet (42); and an outlet (44); a heat absorption heat exchanger (64); a separator (48) having: an inlet (50) coupled to the outlet of the first ejector to receive refrigerant from the first ejector; a gas outlet (54) coupled to the first compressor to deliver refrigerant to the first compressor; and a liquid outlet (52) coupled to the secondary inlet of the first ejector via the first heat absorption heat exchanger to deliver refrigerant to the first ejector; and means (202, 240) for controllably providing a pressure lift between the first compressor and the second compressor.

20. The system of claim 19 wherein:

the means comprises a second ejector.

21. The system of claim 20 wherein:

the second ejector has, in at least a first mode:

a suction port (206) coupled to the first compressor to receive refrigerant compressed by the first compressor; and an outlet (208) coupled to the second compressor to deliver refrigerant to the second compressor.

22. The system of claim 21 wherein:

the second ejector outlet is coupled to the second compressor inlet via a leg (254) of a heat exchanger (252); and a second leg (256) of the heat exchanger (252), in heat exchange relation with the first leg (254) is between the heat rejection heat exchanger and the primary inlet of the first ejector.

23. The system of claim 21 further comprising:

a valve (260) positioned to selectively switch between:

said first mode; and a second mode wherein a flow to the second ejector suction port is blocked and a bypass flow is provided from the first compressor to the second compressor bypassing the second ejector.

24. The system of claim 1 wherein: the system has no other ejectors other than the first ejector and the second ejector.

25. The system of claim 19 wherein the second ejector has a primary inlet (204) on a flowpath branching from a flowpath from the heat rejection heat exchanger to the primary inlet of the first ejector.

26. A system (200; 250; 270) comprising: a reciprocating compressor comprising: a first section (220) and a second section (221); a heat rejection heat exchanger (30) coupled to the second section to receive refrigerant compressed by the second section; a first ejector (38) having: a primary inlet (40) coupled to the heat rejection heat exchanger to receive refrigerant; a secondary inlet (42); and an outlet (44); a heat absorption heat exchanger (64); a second ejector (202) having: a primary inlet (204) coupled to the heat rejection heat exchanger to receive refrigerant; a secondary inlet (206); and an outlet (208) coupled to the second section to deliver refrigerant to the second section; and a separator (48) having: an inlet (50) coupled to the outlet of the first ejector to receive refrigerant from the first ejector; a gas outlet (54) coupled to the secondary inlet of the second ejector via the first section to deliver refrigerant to the second ejector; and a liquid outlet (52) coupled to the secondary inlet of the first ejector via the heat absorption heat exchanger to deliver refrigerant to the first ejector.

* * * * *